US010131517B2

(12) United States Patent
Iwama

(10) Patent No.: US 10,131,517 B2
(45) Date of Patent: Nov. 20, 2018

(54) IMAGE FORMING APPARATUS

(71) Applicant: Brother Kogyo Kabushiki Kaisha, Nagoya-shi, Aichi-ken (JP)

(72) Inventor: Noritaka Iwama, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/474,278

(22) Filed: Mar. 30, 2017

(65) Prior Publication Data

US 2017/0355545 A1 Dec. 14, 2017

(30) Foreign Application Priority Data

Jun. 8, 2016 (JP) ..... 2016-114755

(51) Int. Cl.
*B65H 85/00* (2006.01)
*B65H 1/26* (2006.01)
(Continued)

(52) U.S. Cl.
CPC ..... *B65H 85/00* (2013.01); *B65H 1/266* (2013.01); *B65H 5/062* (2013.01); *B65H 9/002* (2013.01); *G03G 15/234* (2013.01); *G03G 15/6529* (2013.01); *G03G 21/1604* (2013.01); *B65H 2301/3331* (2013.01); *B65H 2402/31* (2013.01); *B65H 2403/43* (2013.01); *B65H 2404/14212* (2013.01); *B65H 2801/06* (2013.01);
(Continued)

(58) Field of Classification Search
CPC . B65H 5/06; B65H 5/062; B65H 5/36; B65H 5/38; B65H 9/002; B65H 85/00; B65H 2301/3331; B65H 2402/31; B65H 2403/43; B65H 2404/14212
See application file for complete search history.

(56) References Cited

U.S. PATENT DOCUMENTS 5,921,453 A * 7/1999 Suzuki ..... B41F 13/03 226/118.3
9,042,807 B2 * 5/2015 Iino ..... G03G 15/234 399/401
(Continued)

FOREIGN PATENT DOCUMENTS

JP 60082558 A * 5/1985 ..... B65H 23/1888
JP H09-114152 A 5/1997

*Primary Examiner* — Prasad V Gokhale
(74) *Attorney, Agent, or Firm* — Banner & Witcoff, Ltd.

(57) ABSTRACT

An image forming apparatus, including: a sheet cassette; an image former; a fixer; a discharge tray; a conveyor configured to convey a sheet along a conveyance passage; a return conveyor configured to convey the sheet from a branch position between the fixer and the discharge tray to a merge position between the sheet cassette and the image former along a return passage which is branched from the conveyance passage at the branch position, passes below the sheet cassette, and merges with the conveyance passage at the merge position; a switchback roller disposed between the branch position and the discharge tray in the conveyance passage and configured to convey the sheet to the discharge tray when it rotates forwardly and to the return passage when it rotates backwardly; and an intermediate conveyance roller disposed in the return passage at a height level intermediate between the fixer and the sheet cassette.

11 Claims, 8 Drawing Sheets

(51) Int. Cl.

| | |
|---|---|
| ***B65H 5/06*** | (2006.01) |
| ***B65H 9/00*** | (2006.01) |
| ***G03G 15/00*** | (2006.01) |
| ***G03G 15/23*** | (2006.01) |
| ***G03G 21/16*** | (2006.01) |

(52) U.S. Cl.
CPC ..... *G03G 15/6552* (2013.01); *G03G 15/6564* (2013.01); *G03G 2215/00675* (2013.01)

(56) References Cited

U.S. PATENT DOCUMENTS

| | | | | |
|---|---|---|---|---|
| 9,284,157 | B2 * | 3/2016 | Won | B65H 85/00 |
| 2010/0158596 | A1 * | 6/2010 | Inoue | B65H 5/062 399/401 |
| 2012/0228816 | A1 * | 9/2012 | Tomatsu | B41J 3/60 271/3.19 |
| 2013/0082433 | A1 * | 4/2013 | Hashimoto | B65H 85/00 271/3.14 |
| 2017/0205749 | A1 * | 7/2017 | Adaniya | B65H 5/36 |
| 2017/0261906 | A1 * | 9/2017 | Iwama | G03G 15/6529 |

* cited by examiner

IMAGE FORMING APPARATUS

CROSS REFERENCE TO RELATED APPLICATION

The present application claims priority from Japanese Patent Application No. 2016-114755, which was filed on Jun. 8, 2016, the disclosure of which is herein incorporated by reference in its entirety.

BACKGROUND

Technical Field

The present disclosure relates to an image forming apparatus capable of performing duplex printing.

Description of Related Art

There has been known an image forming apparatus configured to perform duplex printing by reversing a sheet for which an image former has formed an image on one surface of the sheet and again conveying the sheet to the image former. In a known image forming apparatus, a reverse path (return path) for reversing the sheet is provided at a lowermost portion of the apparatus.

SUMMARY

In a known image forming apparatus configured to perform duplex printing, a discharge roller, by which the sheet is discharged to a discharge tray provided on an upper surface of the apparatus, functions as a switchback roller and a return conveyor configured to return or re-convey the sheet to the image former is disposed so as to extend in a lowermost portion of the apparatus. With this configuration, the sheet is reversed utilizing a space on the discharge tray, so that it is not necessary to provide the reverse path in the apparatus as required in the conventional apparatus described above, resulting in downsizing of the apparatus.

The configuration, however, increases a distance between the switchback roller and the return conveyor, resulting in an increase in the length of the shortest sheet that can be re-conveyed. It is needed, in such an image forming apparatus, to provide an intermediate conveyance roller between the switchback roller and a lowermost portion of the return conveyor for decreasing the length of the shortest sheet that can be re-conveyed.

The additionally provided intermediate conveyance roller, however, may cause an increase in an overall size of the apparatus. Further, the intermediate conveyance roller may be degraded due to heat generated by a fixer.

An aspect of the present disclosure relates to an image forming apparatus in which an intermediate conveyance roller, which is provided between a switchback roller and a lowermost portion of a return conveyor, is disposed at a position at which the intermediate conveyance roller is less likely to be influenced by heat of the fixer, without involving an increase in an overall size of the apparatus.

In one aspect of the disclosure, an image forming apparatus includes: a sheet cassette configured to support a sheet; an image former configured to form an image on the sheet; a fixer disposed above the sheet cassette and configured to thermally fix the image formed on the sheet; a discharge tray configured to support the sheet on which the image has been thermally fixed by the fixer; a conveyor configured to convey the sheet along a conveyance passage extending from the sheet cassette to the discharge tray via the image former and the fixer; a return conveyor configured to convey the sheet from a branch position located between the fixer and the discharge tray in the conveyance passage to a merge position located between the sheet cassette and the image former along a return passage which is branched from the conveyance passage at the branch position, passes below the sheet cassette, and merges with the conveyance passage at the merge position; a switchback roller disposed between the branch position and the discharge tray in the conveyance passage and configured to convey the sheet to the discharge tray when it rotates forwardly and to convey the sheet to the return passage when it rotates backwardly; and an intermediate conveyance roller disposed in the return passage at a height level intermediate between the fixer and the sheet cassette.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Overall Structure of Image Forming Apparatus

Figure 1:
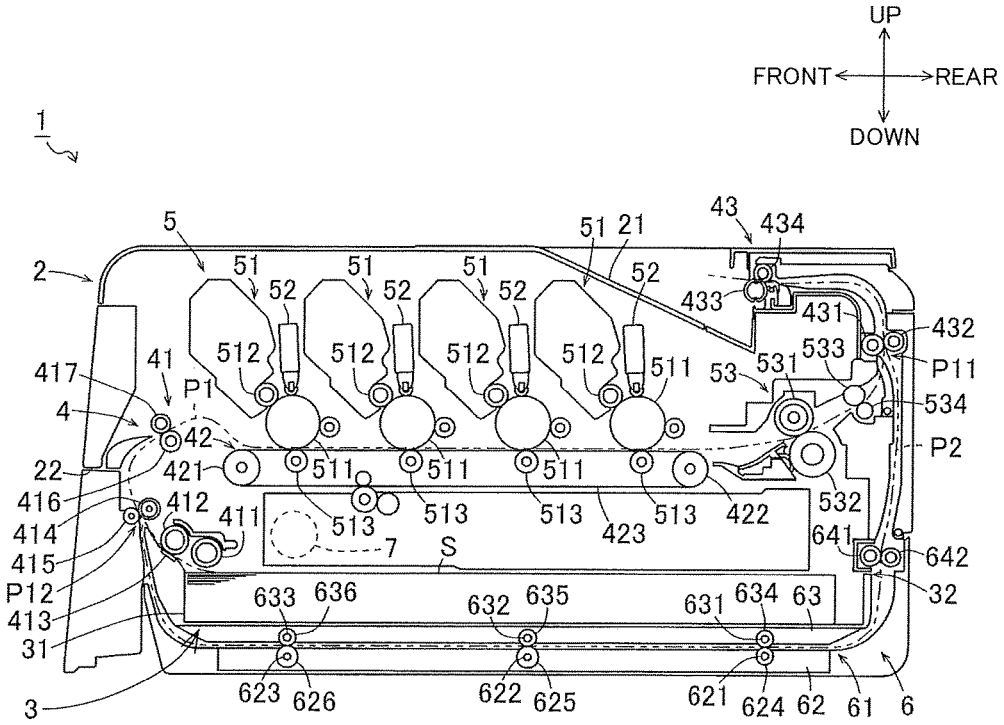
FIG. 1 is a central cross-sectional view of an image forming apparatus according to one embodiment.

FIG. 1 is a central cross-sectional view of an image forming apparatus 1 according to one embodiment. In the following explanation, a front-rear direction and an up-down direction are defined with respect to an attitude of the image forming apparatus 1 placed in its operative position shown in FIG. 1. Further, when viewing the image forming apparatus 1 from the front side, a direction toward a right side is defined as a rightward direction and a direction toward a left side is defined as a leftward direction. Thus, a right-left direction is defined.

The image forming apparatus 1 is a color laser printer configured to form an image in a plurality of colors on a sheet S such as paper or an OHP sheet according to an electrophotographic system. An exterior of the image forming apparatus 1 is constituted by a housing 2 having a generally rectangular parallelepiped shape. The housing 2 houses a sheet cassette 3, a conveyor 4, an image former 5, a fixer 53, a return conveyor 6, and a drive source 7. The image former 5 is disposed at an upper central portion of the housing 2, the fixer 53 is disposed rearward of the image former 5, the conveyor 4 is disposed below and rearward of the image former 5, the sheet cassette 3 is disposed below the conveyor 4, the return conveyor 6 is disposed below the sheet cassette 3 so as to extend over front and rear portions of the housing 2, and the drive source 7 is disposed between the image former 5 and the sheet cassette 3.

A discharge tray 21 is provided on an upper surface of the housing 2 for supporting the sheet S on which an image has been formed by the image former 5. An opening 22 is formed at a lower portion on a front surface of the housing 2. The opening 22 is an inlet through which the sheet cassette 3 and constituent components of the return conveyor 6 are inserted.

The sheet cassette 3 is shaped like a box opening upward and having a sheet storage portion 31. A stack of sheets S is supported on the sheet cassette 3. The sheet cassette 3 is movable in the front-rear direction so as to be removably installed in the housing 2 through the opening 22.

The conveyor 4 is constituted various members disposed along a conveyance passage P1 and is configured to convey the sheet S along the conveyance passage P1. The conveyance passage P1 extends from the sheet cassette 3 to the discharge tray 21 via the image former 5. The conveyor 4 includes a supply portion 41, a belt conveyor portion 42, and a discharge portion 43 arranged in this order from an upstream side in a conveyance direction of the sheet S in the conveyance passage P1.

The supply portion 41 includes a supply roller 411, a separation roller 412, a separator pad 413, conveyance rollers 414, 415, and registering rollers 416, 417. The sheets S stored in the sheet cassette 3 are fed one by one to the conveyance passage P1 by the supply roller 411, the separation roller 412, and the separator pad 413. The sheet S fed to the conveyance passage P1 is conveyed to the image former 5 by the conveyance rollers 414, 415 and the registering rollers 416, 417.

The belt conveyor portion 42 includes a drive roller 421 configured to rotate in conjunction with the image former 5, a driven roller 422 rotatably disposed so as to be spaced apart from the drive roller 421, and a conveyor belt 423 wound around the drive roller 421 and the driven roller 422. When the conveyor belt 423 rotates with the sheet S placed thereon, the sheet S is conveyed along the conveyance passage P1, so as to pass under respective drum units 51 of the image former 5 and then reach the fixer 53.

The discharge portion 43 includes intermediate discharge rollers 431, 432 and the discharge rollers 433, 434 which are disposed between a branch position P11 and the discharge tray 21. Each of the intermediate discharge rollers 431, 432 and the discharge rollers 433, 434 is a switchback roller configured to rotate forwardly and backwardly, namely, the rotational direction of the roller is switchable between a forward direction and a backward direction. The intermediate discharge rollers 431, 432 and the discharge rollers 433, 434 rotate forwardly for discharging the sheet S conveyed from the fixer 53 onto the discharge tray 21 and rotate backwardly for reversing the sheet S and then conveying the sheet S to a return passage P2.

In the present embodiment, the image former 5 is configured to form an image according to an electrophotographic system. It is noted that the image former 5 may form an image according to other system such as a thermal system and an ink-jet system. The image former 5 is the so-called direct tandem image former capable of performing color printing and includes four drum units 51 arranged in the front-rear direction and exposure LED heads 52.

The four drum units 51 are provided to correspond to respective four colors of toners, i.e., black, yellow, magenta, and cyan. Each drum unit 51 includes a photoconductive drum 511, a developing roller 512, and a transfer roller 513 disposed so as to be opposed to the photoconductive drum 511 with the conveyor belt 423 interposed therebetween.

In the thus constructed image former 5, each photoconductive drum 511 charged uniformly by a charger is selectively exposed by the corresponding exposure LED head 52, and electric charges are selectively removed by the exposure from the surface of the photoconductive drum 511, so that an electrostatic latent image is formed on a surface of the photoconductive drum 511.

A developing bias is applied to each developing roller 512. When the electrostatic latent image formed on each photoconductive drum 511 is opposed to the corresponding developing roller 512, the toner is supplied from the developing roller 512 to the electrostatic latent image owing to a potential difference between the electrostatic latent image and the developing roller 512. Thus, a toner image is formed on the surface of each photoconductive drum 511.

The sheet S conveyed to the image former 5 is conveyed by the conveyor belt 423 and passes between the conveyor belt 423 and the four photoconductive drums 511. When the toner image formed on the surface of each photoconductive drum 511 is opposed to the sheet S, the toner image is transferred to the sheet S by a transfer bias applied to the transfer roller 513.

The fixer 53 is disposed downstream of the four photoconductive drums 511 in the sheet conveyance direction in the conveyance passage P1. The fixer 53 includes a heating roller 531 and a pressure roller 532 that is held in pressing contact with the heating roller 531. The heating roller 531 is disposed so as to come into contact with one surface of the sheet S on which an image has been formed. The heating roller 531 is configured to rotate in synchronism with the conveyor belt 423 and convey the sheet S while heating the toner. The pressure roller 532 is disposed opposite to the heating roller 531 with the sheet S interposed therebetween so as to press the sheet S toward the heating roller 531. Thus, the pressure roller 532 is rotated by a rotational force received from the heating roller 531 through the sheet S which is in contact with the heating roller 531.

The fixer 53 includes fixing and discharge rollers 533, 534 disposed downstream of the heating roller 531 and the pressure roller 532 in the conveyance direction of the sheet S in the conveyance passage P1.

The sheet S on which the toner image has been transferred by the image former 5 is conveyed to the fixer 53, and the toner image is thermally fixed on the sheet S when the sheet passes between the heating roller 531 and the pressure roller 532. The sheet S on which the toner image has been thermally fixed is conveyed to the intermediate discharge rollers 431, 432 while being nipped by and between the fixing and discharge rollers 533, 534.

The return conveyor 6 is constituted by various members disposed along the return passage P2 and is configured to convey the sheet S along the return passage P2. The return passage P2 branches off from the conveyance passage P1 at the branch position P11 between the fixer 53 and the intermediate discharge rollers 431, 432, passes below the sheet cassette 3, and merges with the conveyance passage P1 at a merge position P12 between the sheet cassette 3 and the image former 5.

The return conveyor 6 includes a chute unit 61 provided below the sheet cassette 3. The chute unit 61 includes a first chute member 62 and a second chute member 63 for guiding the sheet S along the return passage P2. The first chute member 62 is disposed below the return passage P2 and at the lowermost portion of the housing 2. The second chute member 63 is disposed above the return passage P2 so as to be opposed to the first chute member 62. The second chute member 63 is fitted in a groove formed in the first chute member 62. The second chute member 63 is movable in the front-rear direction so as to be insertable into and removable from the housing 2 through the opening 22.

A plurality of conveyance rollers are disposed in the chute unit 61. After an image has been formed on one surface of the sheet S by the image former 5, the sheet S is conveyed to the return passage P2 by backward rotation of the intermediate discharge rollers 431, 432 and the discharge rollers 433, 434. The sheet S thus conveyed to the return passage P2 is conveyed from the branch position P11 and is returned to the merge position P12. The image former 5 forms an image on the other surface of the sheet S that has been re-conveyed from the merge position P12, and the sheet S is thereafter discharged onto the discharge tray 21 by the discharge portion 43.

The return conveyor 6 includes intermediate conveyance rollers 641, 642 disposed upstream of the chute unit 61 in the conveyance direction of the sheet in the return passage P2. The provision of the intermediate conveyance rollers 641, 642 enables conveyance of a sheet having a shorter length in the conveyance direction.

Thus, the image forming apparatus 1 is capable of performing the so-called duplex printing. That is, the sheet S, in which an image has been formed on its one surface by the image former 5, is re-conveyed to the image former 5 through the return passage P2, and an image is formed on the other surface of the sheet S by the image former 5.

Figure 4:
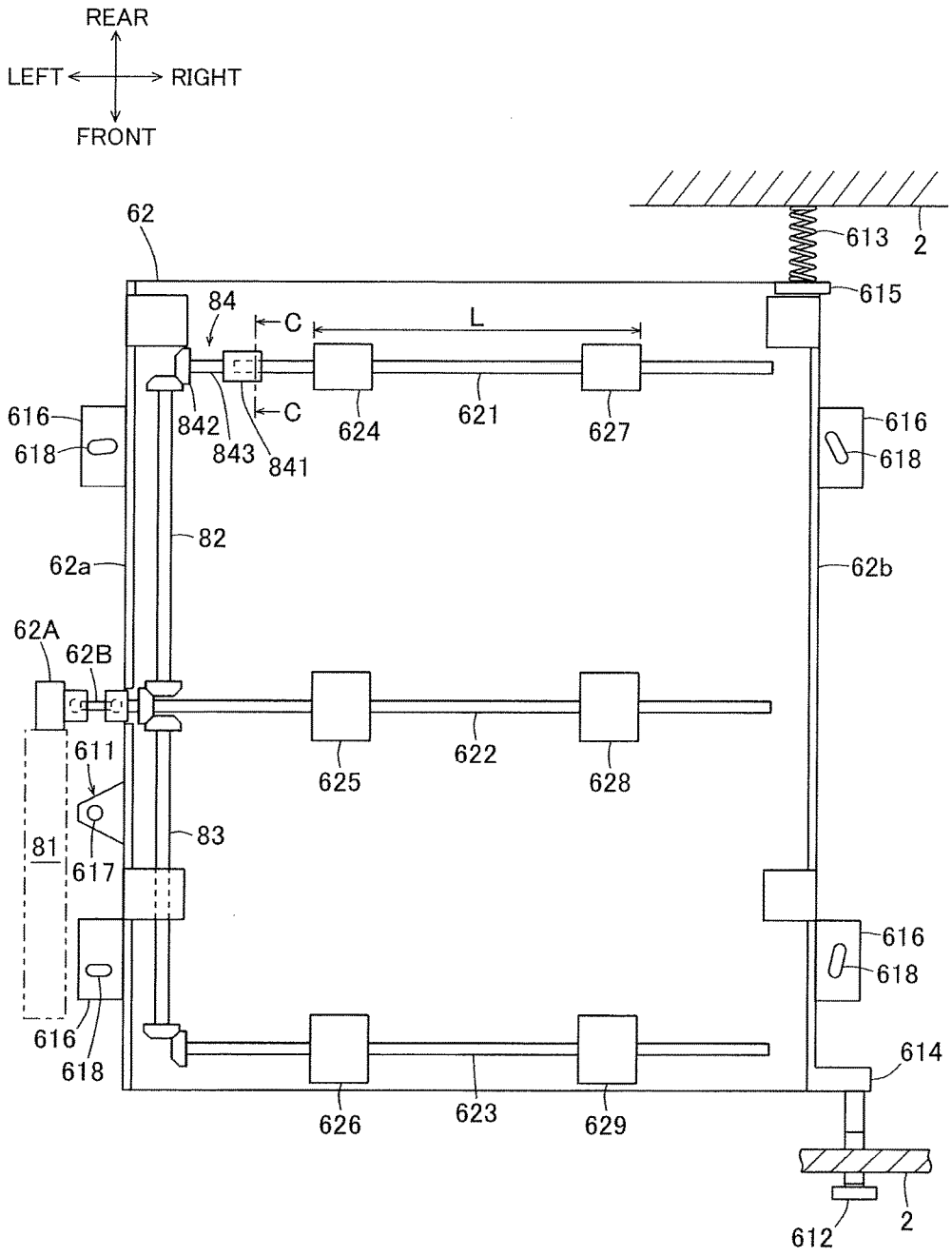
FIG. 4 is a plan view of a first chute member according to the embodiment.

The drive source 7 is disposed above the chute unit 61. A drive force is transmitted from the drive source 7 to the first chute member 62 via a first drive-force transmission mechanism 81 (FIG. 4). The drive source 7 may be constituted to have an electric motor or may be configured to distribute, to the first chute member 62, a part of the drive force transmitted to the conveyor 4 and the image former 5.

Position of Intermediate Conveyance Rollers

The intermediate conveyance rollers 641, 642 are disposed in the return passage P2 at a height level intermediate between the fixer 53 and the sheet cassette 3. Specifically, the intermediate conveyance rollers 641, 642 are disposed at a height level lower than the heating roller 531 of the fixer 53 and higher than a rear upper end portion 32 of the sheet cassette 3.

Heat generated from the fixer 53 tends to transmit upward. The intermediate conveyance rollers 641, 642 disposed at the height level lower than the fixer 53 are less likely to be influenced by the heat, so that the intermediate conveyance rollers 641, 642 are prevented from being degraded due to the heat. It is consequently not necessary to use an expensive, heat-resistant material for the intermediate conveyance rollers 641, 642 and a holder by which the intermediate conveyance rollers 641, 642 are held as a unit.

The intermediate conveyance rollers 641, 642 are disposed at a height level higher than the sheet cassette 3, so that the intermediate conveyance rollers 641, 642 are disposed in a free space in which the intermediate conveyance rollers 641, 642 do not interfere with the sheet cassette 3. Thus, the arrangement eliminates a need to increase the overall size of the housing 2. In general, the sheet cassette 3 has a larger dimension in the front-rear direction. A decrease in a distance between a rear end portion of the sheet cassette 3 and a rear end portion of the housing 2 results in a decrease in the dimension of the image forming apparatus 1 in the front-rear direction.

Structure of Chute Unit

Figure 2:
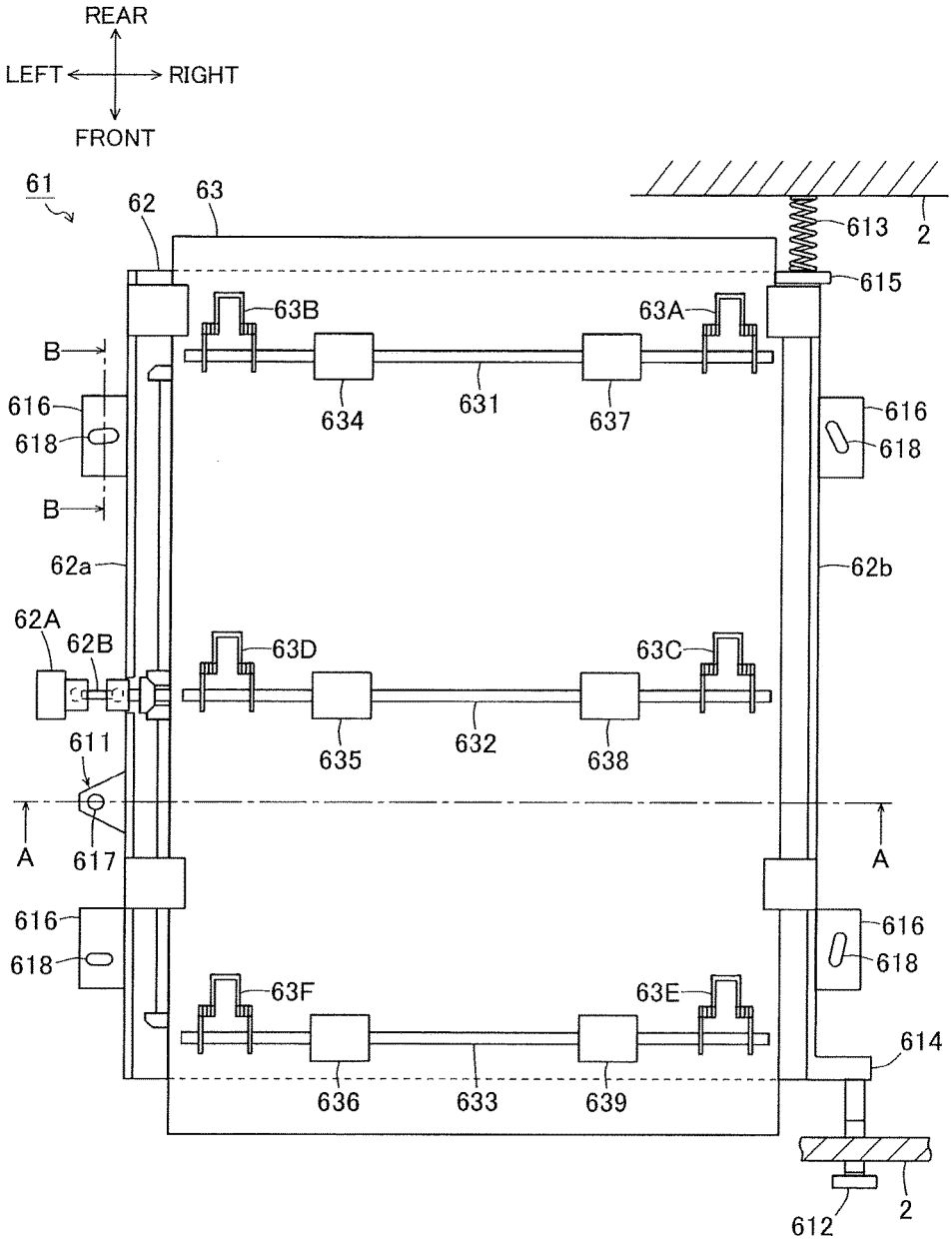
FIG. 2 is a plan view of a chute unit according to the embodiment.
Figure 3:
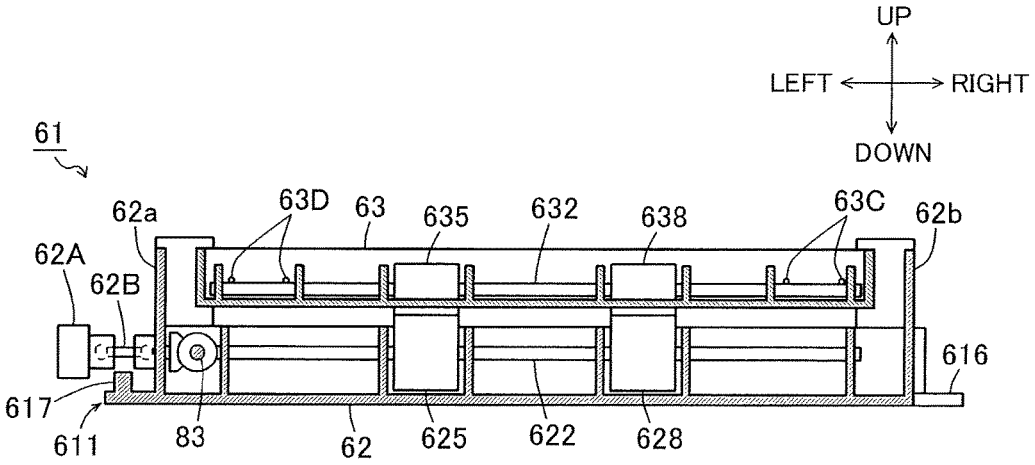
FIG. 3 is a cross-sectional view taken along line A-A in FIG. 2.
Figure 5:
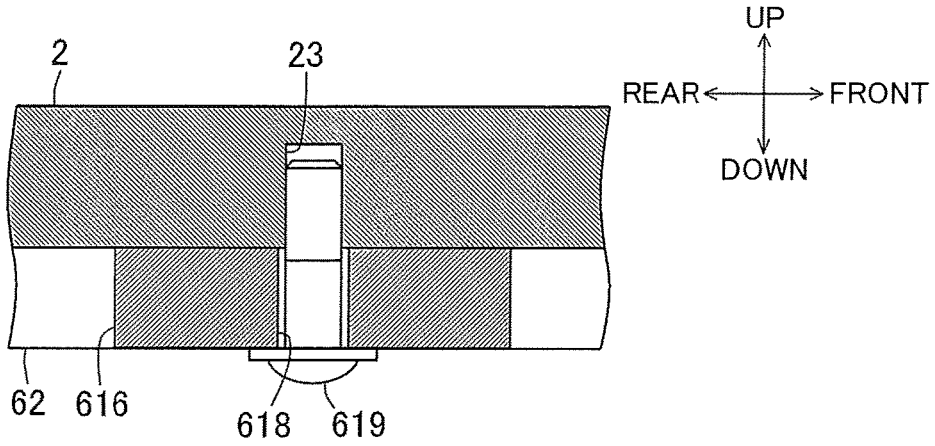
FIG. 5 is a cross-sectional view taken along line B-B in FIG. 2 in a state in which the chute unit is installed on the housing.
Figure 6:
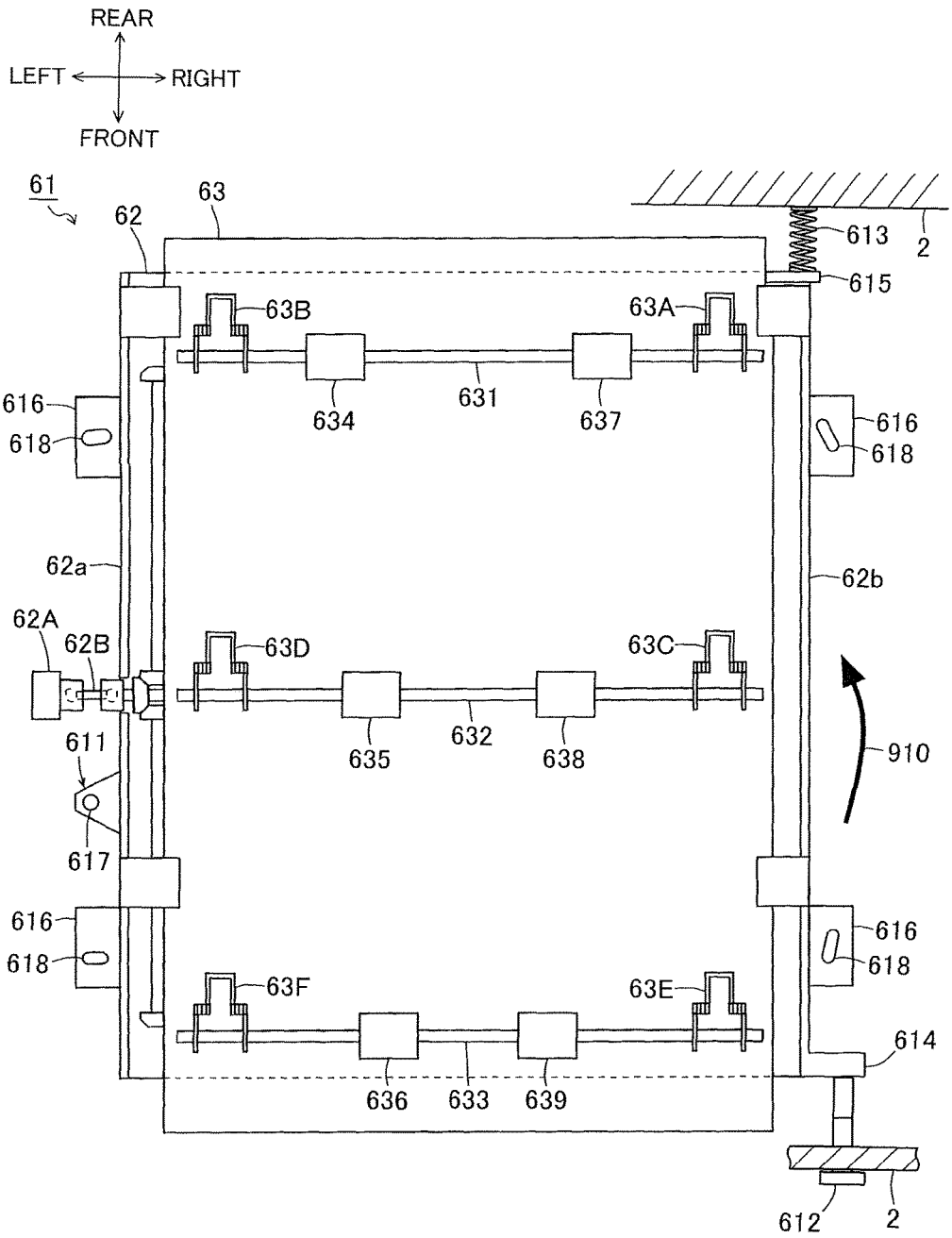
FIG. 6 is a plan view of the chute unit in a state after pivoted in one direction from a position shown in FIG. 2.
Figure 7:
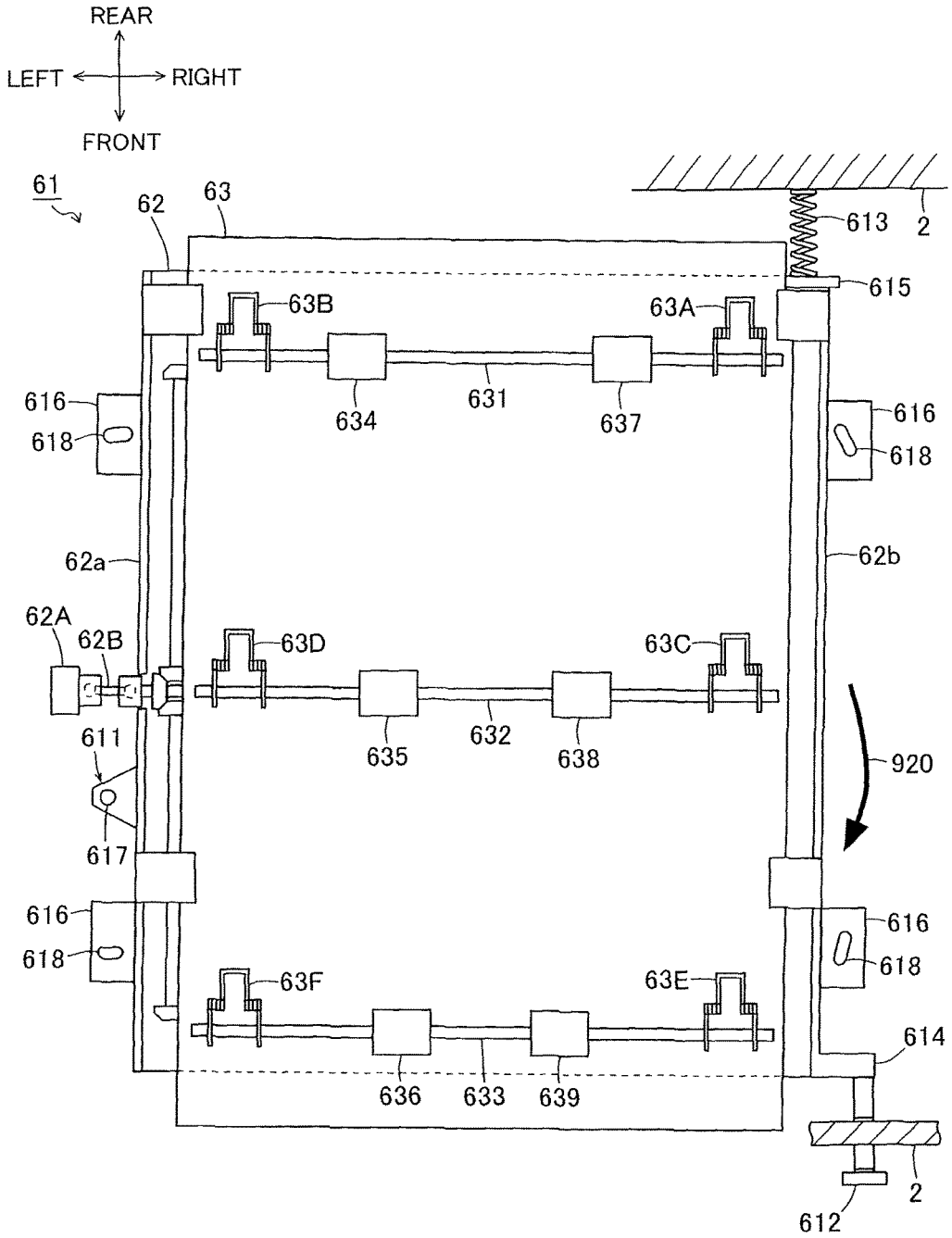
FIG. 7 is a plan view of the chute unit in a state after pivoted in the other direction from a position shown in FIG. 2.
Figure 8A:
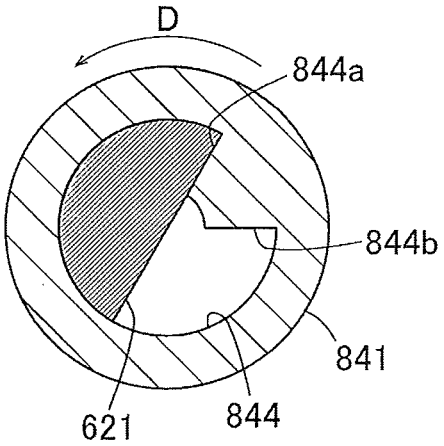
FIGS. 8A and 8B are cross-sectional views taken along line C-C in FIG. 4, FIG. 8A showing a state in which a first rotation shaft is not freely rotating, FIG. 8B showing a state in which the first rotation shaft has been freely rotated.
Figure 8B:
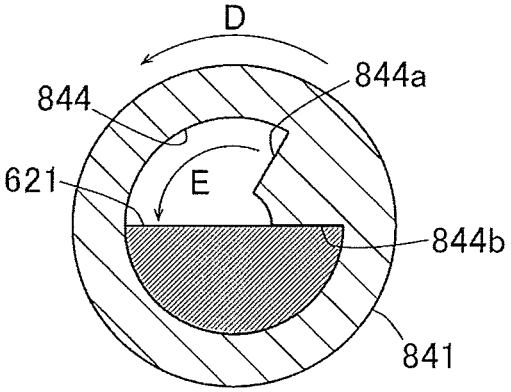

FIG. 2 is a plan view of the chute unit 61. FIG. 3 is a cross-sectional view taken along line A-A in FIG. 2. FIG. 4 is a plan view of the first chute member 62. FIG. 5 is a cross-sectional view taken along line B-B in FIG. 2 in a state in which the chute unit 61 is installed on the housing 2. FIG. 6 is a plan view of the chute unit 61 in a state after pivoted in one direction. FIG. 7 is a plan view of the chute unit 61 in a state after pivoted in the other direction. FIGS. 8A and 8B are cross-sectional views taken along line C-C in FIG. 4. Specifically, FIG. 8A shows a state in which a first rotation shaft is not freely rotating, and FIG. 8B shows a state in which the first rotation shaft has been freely rotated. The chute unit 61 is configured to convey sheets in various sizes such that a widthwise center of each sheet aligns with a widthwise center of the chute unit 61.

As shown in FIG. 4, the first chute member 62 includes a first rotation shaft 621, a second rotation shaft 622, and a third rotation shaft 623. The first rotation shaft 621 has a first conveyance roller 624 and a fourth conveyance roller 627. The second rotation shaft 622 has a second conveyance roller 625 and a fifth conveyance roller 628. The third rotation shaft 623 has a third conveyance roller 626 and a sixth conveyance roller 629.

The first rotation shaft 621 is disposed near a rear end portion of the first chute member 62 which is an upstream end portion thereof in the sheet conveyance direction in the return passage P2. The first rotation shaft 621 extends in a direction orthogonal to the sheet conveyance direction, namely, extends in the right-left direction.

The second rotation shaft 622 is disposed downstream of the first rotation shaft 621 in the sheet conveyance direction in the chute unit 61, so as to be parallel to the first rotation shaft 621. In the present embodiment, the second rotation shaft 622 is located near a central portion of the first chute member 62 in the front-rear direction.

The third rotation shaft 623 is disposed downstream of the second rotation shaft 622 in the sheet conveyance direction in the chute unit 61, so as to be parallel to the first rotation shaft 621. In the present embodiment, the third rotation shaft 623 is located near a front end portion of the first chute member 62.

The first conveyance roller 624 and the fourth conveyance roller 627 have mutually the same diameter. Each of the first conveyance roller 624 and the fourth conveyance roller 627 is constituted by an elastic body formed of rubber or the like. The first conveyance roller 624 and the fourth conveyance roller 627 are disposed respectively on one and the other of opposite sides (i.e., on the left side and the right side) of an axially central portion of the first rotation shaft 621 in the return passage P2. In the present embodiment, the first conveyance roller 624 and the fourth conveyance roller 627 are disposed at respective positions which are distant by the same distance from a central position of the first chute member 62 in the right-left direction. A distance L between a left end of the first conveyance roller 624 and a right end of the fourth conveyance roller 627 is smaller than the shortest width of the sheet on which duplex printing is performable.

The first conveyance roller 624 may be constituted by a single long roller extending to the position of the fourth conveyance roller 627, and the fourth conveyance roller 627 may be omitted.

The second conveyance roller 625 and the fifth conveyance roller 628 have mutually the same diameter. Each of the second conveyance roller 625 and the fifth conveyance roller 628 is constituted by an elastic body formed of rubber or the like. The second conveyance roller 625 and the fifth conveyance roller 628 are disposed respectively on one and the other of opposite sides (i.e., on the left side and the right side) of an axially central portion of the second rotation shaft 622 in the return passage P2. In the present embodiment, the second conveyance roller 625 and the fifth conveyance roller 628 are disposed at respective positions which are distant by the same distance from the central position of the first chute member 62 in the right-left direction, such that a distance between a left end of the second conveyance roller 625 and a right end of the fifth conveyance roller 628 is equal to the above-indicated distance L.

The second conveyance roller 625 and the fifth conveyance roller 628 have a larger diameter than the first conveyance roller 624 and the fourth conveyance roller 627. Consequently, in an instance where the rotational speed of the second conveyance roller 625 and the fifth conveyance roller 628 is made equal to the rotational speed of the first conveyance roller 624 and the fourth conveyance roller 627, the conveying speed of the second conveyance roller 625 and the fifth conveyance roller 628 is higher than the conveying speed of the first conveyance roller 624 and the fourth conveyance roller 627.

The conveyor 4 is generally designed such that the conveying speed becomes lower toward the downstream side in the sheet conveyance direction in the conveyance passage P1. Consequently, by increasing the conveying speed in the return conveyor 6, the sheet S conveyed from the return passage P2 can be smoothly conveyed into the conveyance passage P1 at the merge position P12. In the present embodiment, the rotational speed of the first conveyance roller 624 and the fourth conveyance roller 627 is made equal to the rotational speed of the second conveyance roller 625 and the fifth conveyance roller 628, and the diameter of the second conveyance roller 625 and the fifth conveyance roller 628 is made larger than the diameter of the first conveyance roller 624 and the fourth conveyance roller 627, whereby the conveying speed of the second conveyance roller 625 and the fifth conveyance roller 628 is made higher than the conveying speed of the first conveyance roller 624 and the fourth conveyance roller 627. By thus making the rotational speed of the first conveyance roller 624, the fourth conveyance roller 627, the second conveyance roller 625, and the fifth conveyance roller 628 mutually the same, a drive-force transmission mechanism, which is configured to transmit the rotation drive force from the drive source 7 to the rollers, need not rotate the rollers at different rotational speeds. As a result, it is not necessary, in constituting the drive-force transmission mechanism, to employ combinations of gears which have mutually different gear ratios for the purpose of achieving rotational speeds required by the respective rollers. It is thus possible to easily design the drive-force transmission mechanism.

The second conveyance roller 625 may be constituted by a single long roller extending to the position at the fifth conveyance roller 628, and the fifth conveyance roller 628 may be omitted.

The third conveyance roller 626 and the sixth conveyance roller 629 have mutually the same diameter. Each of the third conveyance roller 626 and the sixth conveyance roller 629 is constituted by an elastic body such as rubber or the like. The third conveyance roller 626 and the sixth conveyance roller 629 are disposed respectively on one and the other of opposite sides (i.e., the left side and the right side) of an axially central portion of the third rotation shaft 623 in the return passage P2. In the present embodiment, the third conveyance roller 626 and the sixth conveyance roller 629 are disposed at respective positions which are distant by the same distance from the central position of the first chute member 62 in the right-left direction, such that a distance between a left end of the third conveyance roller 626 and a right end of the sixth conveyance roller 62 is equal to the above-indicated distance L.

The diameter of the third conveyance roller 626 and the sixth conveyance roller 629 is the same as the diameter of the second conveyance roller 625 and the fifth conveyance roller 628. Consequently, in an instance where the rotational speed of the third conveyance roller 626 and the sixth conveyance roller 629 is made equal to the rotational speed of the second conveyance roller 625 and the fifth conveyance roller 628, the conveying speed of the third conveyance roller 626 and the sixth conveyance roller 629 is equal to the conveying speed of the second conveyance roller 625 and the fifth conveyance roller 628.

The third conveyance roller 626 may be constituted by a single long roller extending to the position of the sixth conveyance roller 629, and the sixth conveyance roller 629 may be omitted. Further, the diameter of the third conveyance roller 626 and the sixth conveyance roller 629 may be made larger than the diameter of the second conveyance roller 625 and the fifth conveyance roller 628, so as to further increase the conveying speed of the third conveyance roller 626 and the sixth conveyance roller 629.

The drive source 7 and the second rotation shaft 622 are connected by the first drive-force transmission mechanism 81, and the drive force is transmitted from the drive source 7 to the second rotation shaft 622. The first rotation shaft 621 and the second rotation shaft 622 are connected by a second drive-force transmission mechanism 82 including miter gears and a connector 84, and the drive force is transmitted from the second rotation shaft 622 to the first rotation shaft 621. The second rotation shaft 622 and the third rotation shaft 623 are connected by a third drive-force transmission mechanism 83 including miter gears, and the drive force is transmitted from the second rotation shaft 622 to the third rotation shaft 623. Each of the first drive-force transmission mechanism 81, the second drive-force transmission mechanism 82, and the third drive-force transmission mechanism 83 may be suitably constituted by combinations of gears, a belt, a rotation shaft, and so on.

With the configuration described above, the drive force is transmitted from the second rotation shaft 622 to the first rotation shaft 621 and the third rotation shaft 623 through the miter gears, whereby the first rotation shaft 621, the second rotation shaft 622, and the third rotation shaft 623 can be driven at the same rotational speed in a simple structure. Thus, the first through sixth conveyance rollers 624-629 are driven at the same rotational speed.

The second rotation shaft 622 is connected to the first drive-force transmission mechanism 81 via a gear 62A and a universal joint 62B which is provided between the gear 62A and the second conveyance roller 625. In this configuration, when the chute unit 61 is pivoted, a displacement of the second rotation shaft 622 is absorbed by the universal joint 62B, and the gear 62A is not displaced. It is thus possible to prevent or reduce a decrease in transmission efficiency of the drive force from the first drive-force transmission mechanism 81 to the gear 62A.

As shown in FIG. 2, the second chute member 63 includes a fourth rotation shaft 631, a fifth rotation shaft 632, and a sixth rotation shaft 633. The fourth rotation shaft 631 has a seventh conveyance roller 634 and a tenth conveyance roller 637. The fifth rotation shaft 632 has an eighth conveyance roller 635 and an eleventh conveyance roller 638. The sixth rotation shaft 633 has a ninth conveyance roller 636 and a twelfth conveyance roller 639.

The fourth rotation shaft 631 is disposed near a rear end portion of the second chute member 63 so as to be located right above and in parallel with the first rotation shaft 621. Opposite end portions of the fourth rotation shaft 631 are downwardly biased by respective double torsional springs 63A, 63B.

The fifth rotation shaft 632 is disposed near a central portion of the second chute member 63 in the front-rear direction so as to be located right above and in parallel with the second rotation shaft 622. Opposite end portions of the fifth rotation shaft 632 are downwardly biased by respective double torsional springs 63C, 63D.

The sixth rotation shaft 633 is disposed near a front end portion of the second chute member 63 so as to be located right above and in parallel with the third rotation shaft 623. Opposite end portions of the sixth rotation shaft 633 are downwardly biased by respective double torsional springs 63E, 63F.

The seventh conveyance roller 634 and the tenth conveyance roller 637 have mutually the same diameter. Each of the seventh conveyance roller 634 and the tenth conveyance roller 637 is formed of resin, such as polyacetal, harder than the elastic body that constitutes the first through sixth conveyance rollers 624-629. The seventh conveyance roller 634 and the tenth conveyance roller 637 are disposed so as to be respectively opposed to the first conveyance roller 624 and the fourth conveyance roller 627 and are held in a pressing contact with the first conveyance roller 624 and the fourth conveyance roller 627 by biasing forces of the double torsional springs 63A, 63B, so as to form a pressure nip therebetween.

The eighth conveyance roller 635 and the eleventh conveyance roller 638 has mutually the same diameter. Each of the eighth conveyance roller 635 and the eleventh conveyance roller 638 is formed of resin, such as polyacetal, harder than the elastic body that constitutes the first conveyance roller 624 through the sixth conveyance roller 629. The eighth conveyance roller 635 and the eleventh conveyance roller 638 are disposed so as to be respectively opposed to the second conveyance roller 625 and the fifth conveyance roller 628 and are held in a pressing contact with the second conveyance roller 625 and the fifth conveyance roller 628 by biasing forces of the double torsional springs 63C, 63D, so as to form a pressure nip therebetween.

The ninth conveyance roller 636 and the twelfth conveyance roller 639 have mutually the same diameter. Each of the ninth conveyance roller 636 and the twelfth conveyance roller 639 is formed of resin, such as polyacetal, harder than the elastic body that constitutes the first through sixth conveyance rollers 624-629. The ninth conveyance roller 636 and the twelfth conveyance roller 639 are disposed so as to be respectively opposed to the third conveyance roller 626 and the sixth conveyance roller 629 and are held in a pressing contact with the third conveyance roller 626 and the sixth conveyance roller 629 by biasing forces of the double torsional springs 63E, 63F, so as to form a pressure nip therebetween.

With this configuration, the first through sixth conveyance rollers 624-629 are driven and rotated, whereby the seventh through twelfth conveyance rollers 634-639 are rotated by rotation of the first through sixth conveyance rollers 624-629 with which the seventh through twelfth conveyance rollers 634-639 are respectively held in a pressing contact.

Each of the fourth through sixth rotation shafts 631-633 may be divided into two shaft portions, i.e., a right shaft portion and a left shaft portion. That is, the fourth rotation shaft 631 may be divided into a shaft portion that supports the seventh conveyance roller 634 and a shaft portion that supports the tenth conveyance roller 637. The fifth rotation shaft 632 may be divided into a shaft portion that supports the eighth conveyance roller 635 and a shaft portion that supports the eleventh conveyance roller 638. The sixth rotation shaft 633 may be divided into a shaft portion that supports the ninth conveyance roller 636 and a shaft portion that supports the twelfth conveyance roller 639.

In the present embodiment, the chute unit 61 includes three pairs of the rotation shafts each having the conveyance rollers. The chute unit 61 may include at least two pairs of the rotation shafts or may include four or more pairs of the rotation shafts.

The chute unit 61 includes a pivotal-movement allowing mechanism 611, an adjusting screw 612, a biasing member 613, a first contact portion 614, a second contact portion 615, and four attaching portions 616.

The pivotal-movement allowing mechanism 611 is configured to allow a pivotal movement of the chute unit 61 described below and is disposed at a first side portion of the chute unit 61 in a width direction of the sheet being conveyed. In the present embodiment, while the first side portion is a left side portion 62*a* of the first chute member 62, the first side portion may be a right side portion 62*b*. Further, the first side portion may be a left side portion or a right side portion of the second chute member 63.

The pivotal-movement allowing mechanism 611 is provided at the left side portion 62*a* near a connected portion of the first drive-force transmission mechanism 81 and the second rotation shaft 622. The pivotal-movement allowing mechanism 611 is provided near a portion of the chute unit 61 to which the drive force is inputted. In this arrangement, when the chute unit 61 is pivoted, a movement amount of the connected portion of the first drive-force transmission mechanism 81 and the second rotation shaft 622 is small, so that it is possible to prevent a reduction in the efficiency of transmission of the drive force from the first drive-force transmission mechanism 81 to the gear 62A. This configuration simplifies design of a mechanism for enabling the pivotal movement of the chute unit 61 while maintaining the transmission efficiency of the drive force.

In an instance where the drive force is input from the first drive-force transmission mechanism 81 to the first rotation shaft 621, it is desirable that the pivotal-movement allowing mechanism 611 be disposed near the connected portion of the first drive-force transmission mechanism 81 and the first rotation shaft 621.

The pivotal-movement allowing mechanism 611 includes a shaft 617 as a pivot center of the chute unit 61. In other words, the shaft 617 defines a pivot axis about which the chute unit 61 is pivotable. The shaft 617 extends in the up-down direction and is inserted into a hole formed in the housing 2 from below. With this configuration, the chute unit 61 is pivotable about the pivot axis which is defined by the shaft 617 and which is perpendicular to the sheet conveyance direction and a direction in which the first rotation shaft 621 extends.

The adjusting screw 612 and the biasing member 613 are for fixing a pivot position of the chute unit 61. The adjusting screw 612 is screwed into a hole formed in the housing 2 in a direction from the front side toward the rear side. A distal end of the adjusting screw 612 is held in contact with the first contact portion 614. The first contact portion 614 is provided at a second side portion of the chute unit 61 in the width direction of the sheet being conveyed. The second side portion is a side portion opposed to the first side portion. In the present embodiment, the second side portion is a right side portion 62*b* of the first chute member 62. The first contact portion 614 is provided at a front end of the right side portion 62*b*, and a front surface of the first contact portion 614 functions as a contact surface with which the adjusting screw 612 is held in contact.

The biasing member 613 biases the first chute member 62 in a direction in which the first contact portion 614 pushes the adjusting screw 612. The biasing member 613 may be constituted by a spring or an elastic member such as rubber. In the present embodiment, the biasing member 613 is a compression coil spring. A rear end of the biasing member 613 is held in contact with the housing 2, and a front end of the biasing member 613 is held in contact with the second contact portion 615. The biasing member 613 is supported by the housing 2 so as to extend and contract in the front-rear direction.

The second contact portion 615 is provided at the right side portion 62*b* of the chute unit 61 which is the second side portion in the width direction of the sheet being conveyed. Specifically, the second contact portion 615 is provided at a rear end of the right side portion 62*b*, and a rear surface of the second contact portion 615 functions as a contact surface with which the biasing member 613 is held in contact.

In the arrangement, the first contact portion 614 and the second contact portion 615 are located distant from the pivotal-movement allowing mechanism 611 of the chute unit 61, whereby it is possible to fix the pivot position of the chute unit 61 with a relatively small force.

The attaching portions 616 are provided for the first chute member 62. In the present embodiment, two attaching portions 616 are provided at the left side portion 62*a* of the first chute member 62, and another two attaching portions 616 are provided at the right side portion 62*b* of the first chute member 62. A hole 618 is formed in each attaching portion 616 so as to penetrate therethrough in the up-down direction. Each hole 618 is formed as an elongate hole for guiding a washer head screw 619 in the pivotal movement of the chute unit 61.

As shown in FIG. 5, the first chute member 62 is disposed at the lowermost portion in the housing 2. The first chute member 62 is attached to the housing 2 by screwing the washer head screws 619, which are inserted into the corresponding holes 618 from below, into corresponding screw holes 23 of the housing 2 which are continuous to the holes 618 on the upper side of the holes 618. By thus attaching the first chute member 62 to the housing 2 from below by use of the washer head screws 619, the first chute member 62 can be easily attached to the lowermost portion of the housing 2. Each washer head screw 619 is screwed into the corresponding screw hole 23 so as to be slidable in the hole 618.

As described above, the pivotal-movement allowing mechanism 611, the adjusting screw 612, the biasing member 613, the first contact portion 614, the second contact portion 615, and the four attaching portions 616 are disposed at the first side portion or the second side portion of the chute unit 61. Consequently, these components can be disposed in a thickness range of the chute unit 61, resulting in a decrease in the height of the image forming apparatus 1.

In this configuration, when the adjusting screw 612 is rotated and moved rearward, the first contact portion 614 is pushed by the adjusting screw 612, so that the chute unit 61 is pivoted counterclockwise in plan view (i.e., in a direction indicated by an arrow 910), as shown in FIG. 6. On the other hand, when the adjusting screw 612 is rotated and moved frontward, the second contact portion 615 is pushed by the biasing member 613, so that the chute unit 61 is pivoted clockwise in plan view (i.e., in a direction indicated by an arrow 920), as shown in FIG. 7.

The connector 84 will be next explained. The connector 84 is disposed coaxially with the first rotation shaft 621 and connects the first rotation shaft 621 and the second drive-force transmission mechanism 82. The connector 84 includes a connecting member 841 connected to a left end portion of the first rotation shaft 621, a miter gear 842 meshing with the miter gear provided at the rear end portion of the second drive-force transmission mechanism 82, and a shaft member 843 connecting the connecting member 841 and the miter gear 842.

As shown in FIGS. 8A and 8B, the connecting member 841 has a hole defining surface 844 which supports the left end portion of the first rotation shaft 621 so as to be freely rotatable by a predetermined play angle. In the present embodiment, the connecting member 841 has a cylindrical shape, and the hole defining surface 844 is formed by boring the connecting member 841 about its rotation axis by 300° in a sectorial shape. The left end portion of the first rotation shaft 621 that is held in contact with the hole defining surface 844 is cut so as to have a semi-circular cross sectional shape.

The first rotation shaft 621 is inserted into the connecting member 841 having the hole defining surface 844 formed as described above, whereby the first rotation shaft 621 is freely rotatable between a state (FIG. 8A) in which the first rotation shaft 621 is in contact with a first inner wall portion 844*a* of the hole defining surface 844 and a state (FIG. 8B) in which the first rotation shaft 621 is in contact with a second inner wall portion 844*b*. An angle by which the first rotation shaft 621 is freely rotatable relative to the connecting member 841 of the connector 84 corresponds to the predetermined play angle. In the present embodiment, the predetermined play angle by which the first rotation shaft 621 is freely rotatable relative to the connector 84 is 120°.

When the connecting member 841 forwardly rotates in a direction indicated by an arrow D in FIG. 8A corresponding to the conveyance direction, the first inner wall portion 844*a* pushes the first rotation shaft 621 in a direction of the forward rotation, so that the first rotation shaft 621 rotates forwardly. Consequently, the first conveyance roller 624 and the fourth conveyance roller 627 are rotated so as to convey the sheet S.

In an instance where the first rotation shaft 621 rotates forwardly faster than the connecting member 841 when the connecting member 841 is rotating forwardly, the first rotation shaft 621 rotates in a direction indicated by an arrow E along the hole defining surface 844 until the first rotation shaft 621 comes into contact with the second inner wall portion 844*b*, as shown in FIG. 8B.

Consequently, in an instance where the second conveyance roller 625 and the fifth conveyance roller 628 pull the sheet S at the conveying speed higher than the conveying speed of the first conveyance roller 624 and the fourth conveyance roller 627, the first conveyance roller 624 and the fourth conveyance roller 627 are freely rotatable forwardly by an amount corresponding to the play angle of the connector 84. Thus, the provision of an appropriate play angle prevents the sheet S from suffering from an excessive load such as slipping on the first conveyance roller 624 and the fourth conveyance roller 627, resulting in stable conveyance of the sheet S.

The play angle of the connector 84 is designed based on a free rotational amount which corresponds to a distance by which the first conveyance roller 624 conveys the sheet S in an instance where the first conveyance roller 624 freely rotates by the play angle. A lower limit value of the free rotational amount of the first conveyance roller 624 is not smaller than a slip amount of the sheet S on the first conveyance roller 624 caused by being conveyed at a speed higher the conveying speed of the first conveyance roller 624 when the sheet S is pulled by the second conveyance roller 625 in an instance where the first conveyance roller 624 does not have the play angle.

In an instance where the sheets are successively conveyed in the return passage P2, an upper limit value of the free rotational amount of the first conveyance roller 624 is desirably smaller than an interval between the sheets S successively conveyed by the first conveyance roller 624. This arrangement enables the freely rotated state of the first conveyance roller 624 to return to the normal driven state before the next sheet S that follows the presently conveyed sheet reaches the first conveyance roller 624.

A range of the free rotational amount is represented by the following formula:

sheet pulled amount≤free rotational amount<interval between successively conveyed sheets In the above formula, the sheet pulled amount is obtained according to the following equation:

$$\text{sheet pulled amount}=(V2-V1)(Y-X)/V1$$

In the above equation, V1 represents the conveying speed of the first conveyance roller 624, V2 represents the conveying speed of the second conveyance roller 625, X represents a distance between the first conveyance roller 624 and the second conveyance roller 625, and Y represents the length of the sheet in the conveyance direction. There may be employed, as the length Y of the sheet in the conveyance direction, a length of the longest sheet that can be conveyed.

Operation of Chute Unit

In duplex printing, the sheet S in which the image has been formed on its one surface by the image former 5 is conveyed to the return passage P2 by backward rotation of the intermediate discharge rollers 431, 432 and the discharge rollers 433, 434. In the return passage P2, the sheet S is conveyed to the chute unit 61 by the intermediate conveyance rollers 641, 642 and is then returned to the merge position P12 by the chute unit 61. In this instance, the first through sixth conveyance rollers 624-629 of the chute unit 61 are driven and rotated, and the seventh through twelfth conveyance rollers 634-639 of the chute unit 61 are rotated by rotation of the first through sixth conveyance rollers 624-629.

The sheet S conveyed to the chute unit 61 is first conveyed by the first conveyance roller 624 and the fourth conveyance roller 627 and subsequently reaches the second conveyance roller 625 and the fifth conveyance roller 628. In the present embodiment, the conveying speed of the second conveyance roller 625 and the fifth conveyance roller 628 is designed to be higher than the conveying speed of the first conveyance roller 624 and the fourth conveyance roller 627. Thus, the sheet S is pulled by the second conveyance roller 625 and the fifth conveyance roller 628.

When the sheet S is pulled by the second conveyance roller 625 and the fifth conveyance roller 628, the first conveyance roller 624 and the fourth conveyance roller 627 rotate at a speed higher than the rotational speed by the drive force transmitted from the drive source 7, and the first rotation shaft 621 freely rotates relative to the connector 84. Consequently, the sheet S does not slip on the first conveyance roller 624 and the fourth conveyance roller 627, so that the sheet S is stably conveyed.

The sheet S conveyed by the second conveyance roller 625 and the fifth conveyance roller 628 reaches the third conveyance roller 626 and the sixth conveyance roller 629. Because the conveying speed of the second conveyance roller 625 and the fifth conveyance roller 628 is equal to the conveying speed of the third conveyance roller 626 and the sixth conveyance roller 629, the sheet S is conveyed without being pulled by the third conveyance roller 626 and the sixth conveyance roller 629.

The sheet S conveyed by the third conveyance roller 626 and the sixth conveyance roller 629 reaches the conveyance rollers 414, 415. The conveying speed of the sheet S has been made closer to the conveying speed of the conveyance rollers 414, 415 by the chute unit 61, so that the sheet S is conveyed with high stability.

In an instance where the sheet S skews in the return passage P2, the chute unit 61 is adjusted for correcting the conveyance direction of the sheet S as described below, so as to permit the sheet S to be stably conveyed to a desired position.

The adjustment of the chute unit 61 for correcting the conveyance direction of the sheet S is performed by pivoting the chute unit 61 as described above. When the sheet S, which is being conveyed from the chute unit 61 to the conveyance rollers 414, 415, skews leftward, the chute unit 61 is pivoted counterclockwise in plan view (i.e., in the direction of the arrow 910), as shown in FIG. 6. As a result, the sheet S which is being conveyed from the chute unit 61 to the conveyance rollers 414, 415 is conveyed more rightward than before the chute unit 61 is pivoted, so that the sheet S is conveyed while being brought near to the widthwise central portion of the conveyance passage.

On the other hand, when the sheet S, which is being conveyed from the chute unit 61 to the conveyance rollers 414, 415, skews rightward, the chute unit 61 is pivoted clockwise in plan view (i.e., in the direction of the arrow 920), as shown in FIG. 7. As a result, the sheet S which is being conveyed from the chute unit 61 to the conveyance rollers 414, 415 is conveyed more leftward than before the chute unit 61 is pivoted, so that the sheet S is conveyed while being brought near to the widthwise central portion of the conveyance passage.

By pivoting the chute unit 61 as described above, the conveyance direction of the skewing sheet S is adjusted in the chute unit 61, so that the sheet S which is directed toward the conveyance rollers 414, 415 can be conveyed to the desired position. With this configuration, the pivot position of the chute unit 61 is adjusted such that the position of the sheet S when conveyed from the sheet cassette 3 to the conveyance rollers 414, 415 and the position of the sheet S when conveyed from the chute unit 61 to the conveyance rollers 414, 415 are aligned with each other, so as to align print positions in the width direction of the sheet between the one surface and the other surface of the sheet in duplex printing.

Advantageous Effects

The image forming apparatus 1 according to the embodiment illustrated above includes the sheet cassette 3 configured to support the sheet S, the image former 5 configured to form an image on the sheet S, the fixer 53 disposed above the sheet cassette 3 and configured to thermally fix the image formed on the sheet S, and the discharge tray 21 configured to support the sheet S on which the image has been thermally fixed by the fixer 53. The image forming apparatus 1 further includes the conveyor 4 configured to convey the sheet along the conveyance passage P1 extending from the sheet cassette 3 to the discharge tray 21 via the image former 5 and the fixer 53. Moreover, the image forming apparatus 1 includes a return conveyor 6 configured to convey the sheet from the branch position P11 located between the fixer 53 and the discharge tray 21 in the conveyance passage P1 to the merge position P12 located between the sheet cassette 3 and the image former 5 along the return passage P2 which is branched from the conveyance passage P1 at the branch position P11, passes below the sheet cassette 3, and merges with the conveyance passage P1 at the merge position P12. The image forming apparatus 1 further includes the intermediate discharge rollers 431, 432 and the discharge rollers 433, 434, each as the switchback roller, disposed between the branch position P11 and the discharge tray 21 in the conveyance passage P1 and configured to convey the sheet S to the discharge tray 21 when it rotates forwardly and to convey the sheet S to the return passage P2 when it rotates backwardly. The image forming apparatus 1 further includes the intermediate conveyance rollers 641, 642 disposed in the return passage P2 at a height level intermediate between the fixer 53 and the sheet cassette 3.

According to the image forming apparatus constructed as described above, the provision of the intermediate conveyance rollers 641, 642 allows a decrease in the length of the shortest sheet that can be re-conveyed. In general, the heat generated from the fixer 53 tends to transmit upward. In view of this, the intermediate conveyance rollers 641, 642 are disposed at a height level lower than the fixer 53, so that the intermediate conveyance rollers 641, 642 are less likely to be influenced by the heat and are accordingly prevented from being degraded by the heat. Further, the intermediate conveyance rollers 641, 642 are disposed at a height level higher than the sheet cassette 3, so that the intermediate conveyance rollers 641, 642 can be disposed in a free space in which the intermediate conveyance rollers 641, 642 do not interfere with the sheet cassette 3, eliminating a need to increase the overall size of the housing 2.

The image forming apparatus 1 according to the embodiment illustrated above includes the first conveyance roller 624 disposed downstream of the intermediate conveyance rollers 641, 642 in the conveyance direction of the sheet in the return passage P2 and the second conveyance roller 625 disposed downstream of the first conveyance roller 624 in the conveyance direction of the sheet in the return passage P2. The conveying speed of the second conveyance roller 625 is higher than the conveying speed of the first conveyance roller 624.

In general, the conveyor 4 is designed such that the conveying speed becomes lower toward the downstream side in the conveyance direction of the sheet in the conveyance passage P1. According to the image forming apparatus constructed as described above, the conveying speed is increased in the return conveyor 6, thereby allowing the sheet S to be smoothly conveyed into the conveyance passage P1 at the merge position P12.

The image forming apparatus 1 according to the embodiment illustrated above includes the drive source 7 configured to give the drive force to the first conveyance roller 624 and the second conveyance roller 625. The rotational speed of the first conveyance roller 624 and the rotational speed of the second conveyance roller 625 are equal to each other, and the diameter of the second conveyance roller 625 is larger than the diameter of the first conveyance roller 624.

According to the image forming apparatus 1 constructed as described above, the drive-force transmission mechanism for transmitting the drive force from the drive source 7 to the respective rollers is more simple in structure and is designed more easily, as compared with an arrangement in which the diameter of the first conveyance roller 624 and the diameter of the second conveyance roller 625 are made equal to each other and the rotational speed of the second conveyance roller 625 is made higher than the rotational speed of the first conveyance roller 624.

In the image forming apparatus 1 according to the embodiment illustrated above, the return conveyor 6 is constituted as the chute unit 61 disposed below the sheet cassette 3. The first conveyance roller 624 is disposed near the upstream end portion of the chute unit 61 in the conveyance direction of the sheet in the return passage P2, and the second conveyance roller 625 is disposed near the central portion of the chute unit 61 in the conveyance direction of the sheet in the return passage P2.

In the image forming apparatus 1 constructed as described above, the conveying speed is increased in the chute unit 61, thereby stably increasing the conveying speed at a flat portion of the return passage P2.

The image forming apparatus 1 according to the embodiment illustrated above includes the first drive-force transmission mechanism 81 configured to transmit the drive force from the drive source 7 to the second conveyance roller 625, the second drive-force transmission mechanism 82 configured to transmit the drive force from the second conveyance roller 625 to the first conveyance roller 624, and the pivotal-movement allowing mechanism 611 disposed near the second conveyance roller 625 of the chute unit 61 and configured to allow the pivotal movement of the chute unit 61 about the pivot axis perpendicular to the conveyance direction of the sheet in the return passage P2 and the direction in which the rotation axis of the first conveyance roller 624 extends.

According to the image forming apparatus 1 constructed as described above, the conveyance direction of the skewing sheet S is adjusted in the chute unit 61 by pivoting the chute unit 61, so that the sheet S which is directed toward the conveyance rollers 414, 415 can be conveyed to the desired position. Further, the pivotal-movement allowing mechanism 611 is provided near the portion of the chute unit 61 to which the drive force is inputted. With this configuration, when the chute unit 61 is pivoted, the movement amount of the connected portion of the first drive-force transmission mechanism 81 and the chute unit 61 is small, so that it is possible to prevent a reduction in the transmission efficiency of the drive force at the connected portion. This configuration simplifies design of a mechanism for enabling the pivotal movement of the chute unit 61 while maintaining the transmission efficiency of the drive force.

The image forming apparatus 1 according to the embodiment illustrated above includes the first rotation shaft 621 which is the rotation shaft of the first conveyance roller 624, the second rotation shaft 622 which is the rotation shaft of the second conveyance roller 625, the drive source 7 configured to give the drive force to the first rotation shaft 621 and the second rotation shaft 622, and the connector 84 which is connected to the first rotation shaft 621 so as to be freely rotatable relative to the first rotation shaft 621 by the predetermined play angle and to which the drive force is inputted from the drive source 7.

According to the image forming apparatus 1 constructed as described above, in an instance where the second conveyance roller 625 pulls the sheet S at the conveying speed higher than the conveying speed of the first conveyance roller 624, the first conveyance roller 624 can freely rotate forwardly by an amount corresponding to the play angle of the connector 84. Thus, the provision of an appropriate play angle prevents the sheet S from suffering from an excessive load such as slipping on the first conveyance roller 624, resulting in stable conveyance of the sheet S.

In the image forming apparatus 1 according to the embodiment illustrated above, the free rotational amount, by which the first conveyance roller 624 is freely rotatable relative to the connector 84 by the play angle, is not smaller than the slip amount of the sheet on the first conveyance roller 624 caused by being conveyed at a speed higher than the conveying speed of the first conveyance roller 624 when the sheet S is pulled by the second conveyance roller 625 in an instance where the play angle is not present between the first rotation shaft 621 and the connector 84. Further, in an instance where the sheets S are successively conveyed in the return passage P2, the free rotational amount described above is desirably smaller than an interval between the sheets S successively conveyed by the first conveyance roller 624.

According to the image forming apparatus 1 constructed as described above, the play angle can be designed to obtain a necessary free rotational amount.

What is claimed is:

1. An image forming apparatus, comprising:

a sheet cassette configured to support a sheet;

an image former configured to form an image on the sheet;

a fixer disposed above the sheet cassette and configured to thermally fix the image formed on the sheet;

a discharge tray configured to support the sheet on which the image has been thermally fixed by the fixer;

a conveyor configured to convey the sheet along a conveyance passage extending from the sheet cassette to the discharge tray via the image former and the fixer;

a return conveyor configured to convey the sheet from a branch position, located between the fixer and the discharge tray in the conveyance passage, to a merge position, located between the sheet cassette and the image former, along a return passage which branches from the conveyance passage at the branch position, passes below the sheet cassette, and merges with the conveyance passage at the merge position;

a switchback roller disposed between the branch position and the discharge tray in the conveyance passage and configured to convey the sheet to the discharge tray when the switchback roller rotates forwardly and to convey the sheet to the return passage when the switchback roller rotates backwardly; and a pair of intermediate conveyance rollers disposed in the return passage at a height level intermediate between the fixer and the sheet cassette, an upper end of the each of the intermediate conveyance rollers being disposed at a height level lower than a lower end of the fixer, a lower end of each of the intermediate conveyance rollers being disposed at a height level higher than an upper end of the sheet cassette, wherein a front end of one of the intermediate conveyance rollers is disposed at a front side of a rear end of the sheet cassette.

2. The image forming apparatus according to claim 1, further comprising:

a first conveyance roller disposed downstream of the intermediate conveyance rollers in a conveyance direction of the sheet in the return passage; and a second conveyance roller disposed downstream of the first conveyance roller in the conveyance direction of the sheet in the return passage, wherein the return passage comprises a first curved portion disposed between the intermediate conveyance rollers and the first conveyance roller, the first curved portion connecting a first up-down passage, extending in an up-down direction, of the return passage and a front-rear passage, extending in a front-rear direction, of the return passage, and wherein a conveying speed of the second conveyance roller is higher than that of the first conveyance roller.

3. The image forming apparatus according to claim 2, further comprising a drive source configured to give a drive force to the first conveyance roller and the second conveyance roller, wherein a rotational speed of the first conveyance roller and a rotational speed of the second conveyance roller are equal to each other, and a diameter of the second conveyance roller is larger than that of the first conveyance roller.

4. The image forming apparatus according to claim 3, wherein the return conveyor comprises a guide configured to guide the sheet along the return passage and is disposed below the sheet cassette, and wherein the first conveyance roller is disposed near an upstream end portion of the guide in the conveyance direction, and the second conveyance roller is disposed near a central portion of the guide in the conveyance direction.

5. The image forming apparatus according to claim 4, further comprising:

a first drive-force transmission mechanism configured to transmit the drive force from the drive source to the second conveyance roller;

a second drive-force transmission mechanism configured to transmit the drive force from the second conveyance roller to the first conveyance roller; and a pivotal-movement allowing mechanism disposed near the second conveyance roller of the guide and configured to allow a pivotal movement of the guide about a pivot axis perpendicular to the conveyance direction and a direction in which a rotation axis of the first conveyance roller extends.

6. The image forming apparatus according to claim 2, further comprising:

a first rotation shaft which is a rotation shaft of the first conveyance roller;

a second rotation shaft which is a rotation shaft of the second conveyance roller;

a drive source configured to provide a drive force to the first rotation shaft and the second rotation shaft; and a connector which is connected to the first rotation shaft so as to be freely rotatable relative to the first rotation shaft by a predetermined play angle and to which the drive force is inputted from the drive source.

7. The image forming apparatus according to claim 2, further comprising a third conveyance roller disposed downstream of the second conveyance roller in the conveyance direction of the sheet in the return passage, wherein the return passage comprises a second curved portion disposed downstream of the third conveyance roller in the conveyance direction, the second curved portion connecting the front-rear passage, extending in the front-rear direction, of the return passage and a second up-down passage, extending in the up-down direction, of the return passage.

8. The image forming apparatus according to claim 1, further comprising an intermediate discharge roller disposed upstream of the intermediate conveyance rollers, in a conveyance direction in the return passage, the intermediate discharge roller being capable of forward rotation and backward rotation, wherein a front end of the intermediate discharge roller is disposed between the front end and a rear end of the one of the intermediate conveyance rollers in a front-rear direction, wherein an imaginary line parallel to the up-down direction overlaps both of the one of the intermediate conveyance rollers and the intermediate discharge roller when viewed in a direction in which an axis of the one of the intermediate conveyance rollers extends, and wherein the intermediate conveyance rollers and the intermediate discharge roller are arranged in the conveyance direction.

9. An image forming apparatus, comprising:

a sheet cassette configured to support a sheet;

an image former configured to form an image on the sheet;

a fixer disposed above the sheet cassette and configured to thermally fix the image formed on the sheet;

a discharge tray configured to support the sheet on which the image has been thermally fixed by the fixer;

a conveyor configured to convey the sheet along a conveyance passage extending from the sheet cassette to the discharge tray via the image former and the fixer;

a return conveyor configured to convey the sheet from a branch position, located between the fixer and the discharge tray in the conveyance passage, to a merge position, located between the sheet cassette and the image former, along a return passage which branches from the conveyance passage at the branch position, passes below the sheet cassette, and merges with the conveyance passage at the merge position;

a switchback roller disposed between the branch position and the discharge tray in the conveyance passage and configured to convey the sheet to the discharge tray when the switchback roller rotates forwardly and to convey the sheet to the return passage when the switchback roller rotates backwardly;

an intermediate conveyance roller disposed in the return passage at a height level intermediate between the fixer and the sheet cassette, an upper end of the intermediate conveyance roller being disposed at a height level lower than a lower end of the fixer, a lower end of the intermediate conveyance roller being disposed at a height level higher than an upper end of the sheet cassette; and an intermediate discharge roller disposed upstream of the intermediate conveyance roller in a conveyance direction of the sheet in the return passage, wherein an intermediate-part of the return passage is a part of the return passage, the intermediate-part of the return passage extending from the intermediate discharge roller to the intermediate conveyance roller, and wherein a downstream side of the intermediate-part of the return passage inclines frontwardly as the downstream side of the intermediate-part approaches the intermediate conveyance roller.

10. The image forming apparatus according to claim 9 wherein an upstream side of the intermediate-part of the return passage inclines rearwardly as the upstream side of the intermediate-part approaches the intermediate conveyance roller, the upstream side of the intermediate-part of the return passage being disposed upstream of the downstream side of the intermediate-part of the return passage in the conveyance direction.

11. An image forming apparatus, comprising:

a sheet cassette configured to support a sheet;

an image former configured to form an image on the sheet;

a fixer disposed above the sheet cassette and configured to thermally fix the image formed on the sheet;

a discharge tray configured to support the sheet on which the image has been thermally fixed by the fixer;

a conveyor configured to convey the sheet along a conveyance passage extending from the sheet cassette to the discharge tray via the image former and the fixer;

a return conveyor configured to convey the sheet from a branch position, located between the fixer and the discharge tray in the conveyance passage, to a merge position, located between the sheet cassette and the image former, along a return passage which branches from the conveyance passage at the branch position, passes below the sheet cassette, and merges with the conveyance passage at the merge position;

a switchback roller disposed between the branch position and the discharge tray in the conveyance passage and configured to convey the sheet to the discharge tray when the switchback roller rotates forwardly and to convey the sheet to the return passage when the switchback roller rotates backwardly;

an intermediate conveyance roller disposed in the return passage at a height level intermediate between the fixer and the sheet cassette;

a first conveyance roller disposed downstream of the intermediate conveyance roller in a conveyance direction of the sheet in the return passage;

a second conveyance roller disposed downstream of the first conveyance roller in the conveyance direction of the sheet in the return passage, a first rotation shaft which is a rotation shaft of the first conveyance roller;

a second rotation shaft which is a rotation shaft of the second conveyance roller;

a drive source configured to provide a drive force to the first rotation shaft and the second rotation shaft; and a connector which is connected to the first rotation shaft so as to be freely rotatable relative to the first rotation shaft by a predetermined play angle and to which the drive force is inputted from the drive source, wherein a conveying speed of the second conveyance roller is higher than a conveyance speed of the first conveyance roller, and wherein a free rotational amount, by which the first conveyance roller is freely rotatable relative to the connector by the predetermined play angle, is not smaller than a slip amount of the sheet on the first conveyance roller determined based on a difference between the conveyance speed of the second conveyance roller and the conveyance speed of the first conveyance roller.

* * * * *